US009645516B2

(12) United States Patent
Kawahara et al.

(10) Patent No.: US 9,645,516 B2
(45) Date of Patent: May 9, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masataka Kawahara, Mishima (JP); Masato Tanaka, Tagata-gun (JP); Jumpei Kuno, Mishima (JP); Tsutomu Nishida, Mishima (JP); Kaname Watariguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/936,545

(22) Filed: Nov. 9, 2015

(65) Prior Publication Data

US 2016/0139516 A1 May 19, 2016

(30) Foreign Application Priority Data

Nov. 19, 2014 (JP) ..... 2014-234939
Oct. 28, 2015 (JP) ..... 2015-211937

(51) Int. Cl.
*G03G 5/06* (2006.01)
*G03G 5/05* (2006.01)

(52) U.S. Cl.
CPC ..... *G03G 5/0696* (2013.01); *G03G 5/05* (2013.01); *G03G 5/056* (2013.01); *G03G 5/0618* (2013.01)

(58) Field of Classification Search
CPC ..... G03G 5/0696; G03G 5/056
See application file for complete search history.

(56) References Cited

U.S. PATENT DOCUMENTS 5,194,088 A * 3/1993 Babler ..... C09B 67/0002 106/31.75
5,246,807 A 9/1993 Kanemaru et al.
5,834,149 A * 11/1998 Tambo ..... C09B 67/0016 106/413
6,190,811 B1 2/2001 Tanaka et al.
6,245,472 B1 6/2001 Tanaka
6,248,490 B1 6/2001 Suzuki et al.
6,270,936 B1 8/2001 Tanaka et al.
6,472,524 B2 10/2002 Tanaka
7,604,913 B2 * 10/2009 Tajima ..... G03G 5/056 399/159
8,765,335 B2 7/2014 Tanaka et al.
8,974,991 B2 3/2015 Kawahara et al.
9,068,083 B2 6/2015 Tanaka et al.
9,217,938 B2 12/2015 Tanaka
9,223,233 B2 12/2015 Tanaka
2014/0170541 A1 6/2014 Tanaka
2014/0170542 A1 6/2014 Tanaka
2014/0308606 A1 10/2014 Tanaka et al.
2015/0093693 A1 4/2015 Watariguchi et al.
2015/0093694 A1 4/2015 Watariguchi et al.
2015/0301461 A1 10/2015 Tanaka
2015/0309426 A1 10/2015 Nishida et al.
2015/0316862 A1 11/2015 Kuno et al.
2015/0316863 A1 11/2015 Tanaka et al.
2015/0316864 A1 11/2015 Kuno et al.
2015/0346616 A1 12/2015 Kawahara et al.
2015/0346617 A1 12/2015 Kawahara et al.
2015/0362847 A1 12/2015 Tanaka et al.
2015/0370181 A1 12/2015 Tanaka et al.
2016/0124325 A1 * 5/2016 Nishida ..... G03G 5/047 399/111
2016/0154326 A1 * 6/2016 Kumoi ..... G03G 5/043 399/111
2016/0252832 A1 * 9/2016 Tanaka ..... G03G 5/047

FOREIGN PATENT DOCUMENTS

JP 05279591 A * 10/1993
JP 07053892 A * 2/1995
JP 7-331107 A 12/1995
JP 10-20514 A 1/1998
JP 2000258930 A * 9/2000
JP 2007072277 A * 3/2007
JP 2010060706 A * 3/2010

OTHER PUBLICATIONS

English language machine translation of JP 2007-072277 (Mar. 2007).*
English language machine translation of JP 07-053892 (Feb. 1995).*
English language machine translation of JP 2010-060706 (Mar. 2010).*
Tanaka, U.S. Appl. No. 14/442,399, filed May 12, 2015.
Tanaka, et al., U.S. Appl. No. 14/888,646, filed Nov. 2, 2015.
Kawahara, et al., U.S. Appl. No. 14/878,208, filed Oct. 8, 2015.
Tanaka, et al., U.S. Appl. No. 14/928,769, filed Oct. 30, 2015.
Kumoi, et al., U.S. Appl. No. 14/943,830, filed Nov. 17, 2015.
Kumoi, et al., U.S. Appl. No. 14/927,300, filed Oct. 29, 2015.

* cited by examiner

*Primary Examiner* — Christopher Rodee
(74) *Attorney, Agent, or Firm* — Fitzpatrick Cella Harper and Scinto

(57) ABSTRACT

An electrophotographic photosensitive member including a support, and a charge generating layer and a charge transporting layer on the support, wherein the charge generating layer includes a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 1.5% or less based on a gallium phthalocyanine in the gallium phthalocyanine crystal, and the charge transporting layer includes a polyester resin having a structural unit represented by formula (1).

$$-(A\text{-}B)- \qquad (1).$$

12 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including the electrophotographic photosensitive member.

Description of the Related Art

Currently, an electrophotographic photosensitive member is generally a functional separation type laminated photosensitive member in which a charge-generating function (charge generating layer) and a charge-transporting function (charge transporting layer) are shared in respective separate layers.

With respect to a charge-generating substance having the charge-generating function, the emission wavelength of a semiconductor laser commonly used as an image exposing unit is as long as from 650 to 820 nm, and therefore a charge-generating substance having a high sensitivity to light of a long wavelength is developed in progress.

A phthalocyanine pigment is effective as such a charge-generating substance having a high sensitivity to light up to a long wavelength region, and in particular, oxytitanium phthalocyanine and gallium phthalocyanine, having excellent sensitive characteristics, have been heretofore reported with respect to various crystal forms and improved production methods.

Japanese Patent Application Laid-Open No. H07-331107 discloses a hydroxygallium phthalocyanine crystal containing a polar organic solvent. N,N-dimethylformamide is used for a conversion solvent to thereby allow the polar organic solvent to be incorporated in the crystal, providing a crystal having excellent sensitive characteristics. On the contrary, a problem is, however, that a photocarrier produced easily remains in a photosensitive layer and such a remaining photocarrier easily causes image defects such as fogging and a black spot.

On the other hand, the charge transporting layer having the charge transporting function is demanded to have mechanical strength and less degradation of discharge because of having the charge transporting function and being located on the outermost surface of the electrophotographic photosensitive member. Accordingly, a charge transporting material having high mobility and a resin having a strong mechanical strength and having resistance to discharge are developed in progress.

In particular, a problem is that the charge transporting layer is made thinner due to abrading in repeated use of the photosensitive member, to thereby result in an increase in electric field strength to cause fogging (a phenomenon where a toner is slightly developed in a region in which the toner is not to be essentially developed).

Japanese Patent Application Laid-Open No. H10-20514 describes a polyarylate resin excellent in wear resistance, and provides a photosensitive member excellent in wear resistance.

SUMMARY OF THE INVENTION

As described above, various improvements have been tried with respect to the electrophotographic photosensitive member.

However, fogging has been demanded to be further prevented from the viewpoints of response to a higher image quality and suppression of the amount of a toner to be consumed, in recent years.

An object of the present invention is to provide an electrophotographic photosensitive member that can have an improved charge generating material in a charge generating layer of a functional separation type laminated photosensitive member and an improved charge transporting layer thereof to thereby allow a high-quality image, in which fogging is sufficiently suppressed, to be output even if the charge transporting layer is made thinner by repeated use of the photosensitive member.

Another object of the present invention is to provide an electrophotographic apparatus and a process cartridge including the electrophotographic photosensitive member.

The present invention provides an electrophotographic photosensitive member including a support, and a charge generating layer and a charge transporting layer on the support, wherein the charge generating layer includes a gallium phthalocyanine crystal in which an organic compound is contained, wherein the organic compound is at least one selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 1.5% by mass or less based on a phthalocyanine compound in the gallium phthalocyanine crystal, and the charge transporting layer includes a polyester resin having structural units represented by the formula (1):

$$-(A\text{-}B)- \tag{1}$$

wherein, in the formula (1), "A" represents a divalent group represented by formula (2), and "B" represents a divalent group represented by formula (4) or formula (5);

(2)

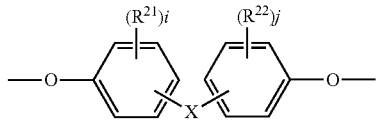

wherein, in the formula (2), $R^{21}$ and $R^{22}$ each independently represent an alkyl group, an aryl group or an alkoxy group, and i and j each independently represent an integer of 0 to 4; and in the formula (2), X represents a group represented by any of formulae (3-1) to (3-7):

(3-1)

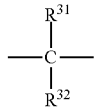

(3-2)

(3-3)

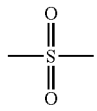

(3-4)

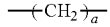

(3-5)

-continued (3-6)

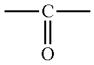

(3-7)

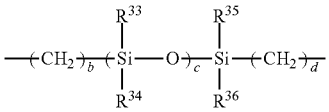

wherein, in the formula (3-1), $R^{31}$ and $R^{32}$ represent a hydrogen atom, a halogen atom, a substituted or unsubstituted alkyl group, a substituted or unsubstituted aryl group, a substituted or unsubstituted alkoxy group, a substituted or unsubstituted alkenyl group, or a group required to form a cycloalkyl ring or a heterocyclic ring by bonding of $R^{31}$ and $R^{32}$; in the formula (3-7), $R^{33}$ to $R^{36}$ each independently represent a hydrogen atom, a substituted or unsubstituted alkyl group, or a substituted or unsubstituted aryl group; and in the formula (3-4) and in the formula (3-7), "a" and "b" and "d" represent an integer of 0 to 20, and "c" represents an integer of 1 to 500;

(4)

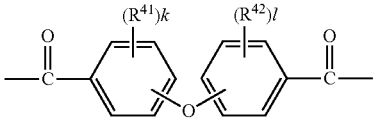

wherein, in the formula (4), $R^{41}$ and $R^{42}$ each independently represent an alkyl group, an aryl group or an alkoxy group, and "k" and "l" each independently represent an integer of 0 to 4;

(5)

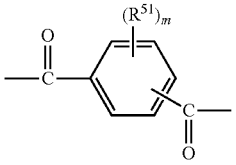

wherein, in the formula (5), $R^{51}$ represents an alkyl group, an aryl group or an alkoxy group, and "m" represents an integer of 0 to 4.

The present invention also provides a process cartridge detachably attachable to a main body of an electrophotographic apparatus, wherein the process cartridge integrally supports the electrophotographic photosensitive member and at least one unit selected from the group consisting of a charging unit, a developing unit and a cleaning unit.

The present invention also provides an electrophotographic apparatus including the electrophotographic photosensitive member, and a charging unit, an image exposing unit, a developing unit and a transferring unit.

Further features of the present invention will become apparent from the following description of exemplary embodiments with reference to the attached drawings.

DESCRIPTION OF THE EMBODIMENTS

Figure 1:
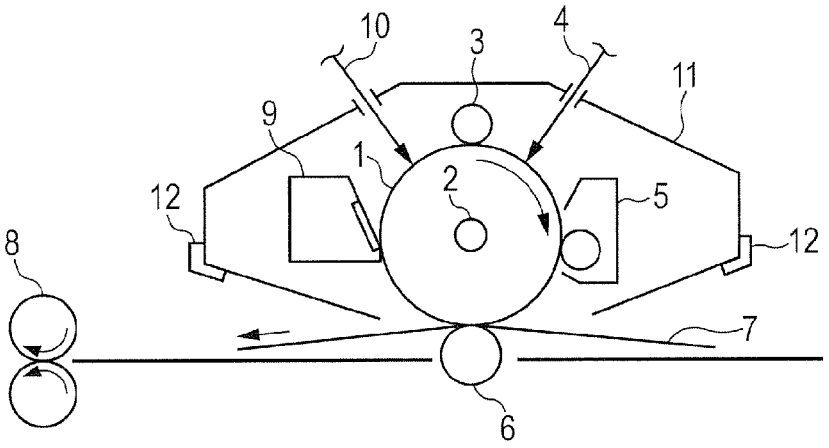
FIG. 1 is a view illustrating one example of a schematic configuration of an electrophotographic apparatus provided with a process cartridge including the electrophotographic photosensitive member of the present invention.

Preferred embodiments of the present invention will now be described in detail in accordance with the accompanying drawings.

The electrophotographic photosensitive member of the present invention is, as described above, an electrophotographic photosensitive member including a support, and a charge generating layer and a charge transporting layer on the support, wherein the charge generating layer includes a gallium phthalocyanine crystal in which an organic compound is contained.

The organic compound is at least one selected from the group consisting of dimethylsulfoxide, N,N-dimethylformamide, N-methylformamide, N-propylformamide, N-vinylformamide and N-methylpyrrolidone.

The content of the organic compound is 0.1% by mass or more and 1.5% by mass or less based on a gallium phthalocyanine in the gallium phthalocyanine crystal.

The charge transporting layer includes a polyester resin having structural units represented by the formula (1):

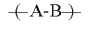

(1)

wherein, in the formula (1), "A" represents a divalent group represented by formula (2), and "B" represents a divalent group represented by formula (4) or formula (5);

(2)

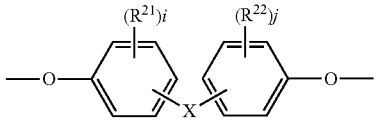

wherein, in the formula (2), $R^{21}$ and $R^{22}$ each independently represent an alkyl group, an aryl group or an alkoxy group, and i and j each independently represent an integer of 0 to 4; and in the formula (2), X represents a group represented by any of formulae (3-1) to (3-7):

(3-1)

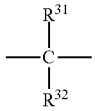

(3-2)

(3-3)

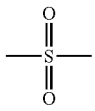

(3-4)

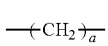

(3-5)

-continued (3-6)

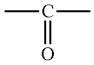

(3-7)

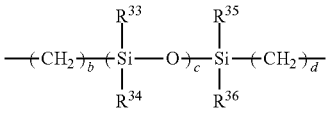

wherein, in the formula (3-1), $R^{31}$ and $R^{32}$ represent a hydrogen atom, a halogen atom, a substituted or unsubstituted alkyl group, a substituted or unsubstituted aryl group, a substituted or unsubstituted alkenyl group, or a group required to form a cycloalkyl ring or a heterocyclic ring by bonding of $R^{31}$ and $R^{32}$; in the formula (3-7), $R^{33}$ to $R^{36}$ each independently represent a hydrogen atom, a substituted or unsubstituted alkyl group, or a substituted or unsubstituted aryl group; and in the formula (3-4) and in the formula (3-7), "a" and "b" and "d" represent an integer of 0 to 20, and "c" represents an integer of 1 to 500;

(4)

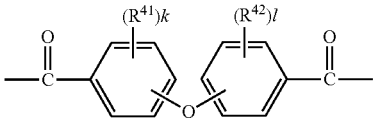

wherein, in the formula (4), $R^{41}$ and $R^{42}$ each independently represent an alkyl group, an aryl group or an alkoxy group, and "k" and "l" each independently represent an integer of 0 to 4;

(5)

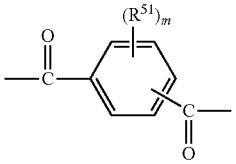

wherein, in the formula (5), $R^{51}$ represents an alkyl group, an aryl group or an alkoxy group, and "m" represents an integer of 0 to 4.

The divalent group represented by the formula (2) is preferably is a divalent group represented by any of formulae (6) to (9).

(6)

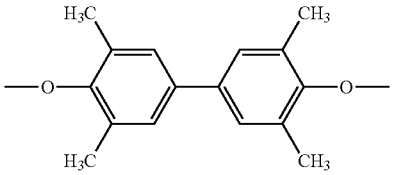

(7)

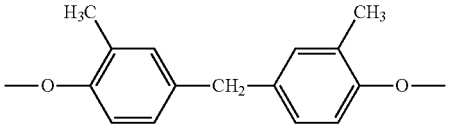

-continued (8)

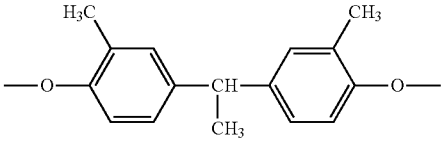

(9)

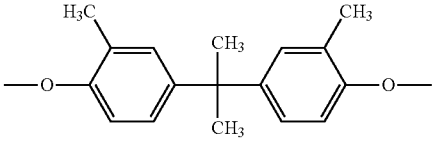

The divalent group represented by the formula (4) is preferably is a divalent group represented by formula (10)

(10)

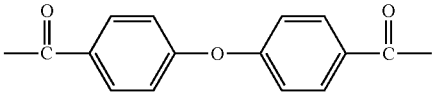

The divalent group represented by the formula (5) is preferably is a divalent group represented by formula (11) or (12).

(11)

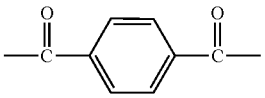

(12)

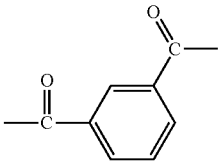

With respect to $R^{21}$ and $R^{22}$ in the formula (2), examples of the alkyl group include a methyl group, an ethyl group, a propyl group and a butyl group, examples of the alkoxy group include a methoxy group, an ethoxy group and a propoxy group, examples of the aryl group include a phenyl group and a naphthyl group, and in particular, a methyl group, an ethyl group, a methoxy group, an ethoxy group and a phenyl group can be preferably adopted.

With respect to $R^{31}$ and $R^{32}$ in the formula (3), examples of the alkyl group include a methyl group, an ethyl group, a propyl group and a butyl group, examples of the alkyl fluoride group include a trifluoromethyl group and a pentafluoroethyl group, examples of the alkenyl group include a vinyl group, an allyl group, a propenyl group and a butenyl group, examples of the aryl group include a phenyl group and a naphthyl group, and in particular, a methyl group, an ethyl group, a propyl group (particularly, an isopropyl group), a trifluoromethyl group and a pentafluoroethyl group can be preferably adopted.

In the formula (3), $R^{31}$ and $R^{32}$ may also be bound to form a cycloalkyl ring (namely, a cycloalkylidene group) or a heterocyclic ring. Examples of the cycloalkylidene group to be formed include a cyclopentylidene group, a cyclohexylidene group and a cycloheptylidene group, examples of the heterocyclic ring group to be formed include pyrrolidine, tetrahydrofuran, tetrahydrothiophene, piperidine, tetrahydropyran and tetrahydrothiopyran, and in particular, a cyclohexylidene group can be preferably adopted.

In the formula (3-4), "a" represents an integer of 0 to 20.

With respect to $R^{33}$ to $R^{36}$ in the formula (3-7), examples of the alkyl group include a methyl group, an ethyl group, a propyl group and a butyl group, examples of the alkyl fluoride group include a trifluoromethyl group and a pentafluoroethyl group, examples of the alkoxy group include a methoxy group, an ethoxy group, a propoxy group and a butoxy group, examples of the alkenyl group include a vinyl group, an allyl group, a propenyl group and a butenyl group, examples of the aryl group include a phenyl group and a naphthyl group, and in particular, a methyl group, an ethyl group, a propyl group (particularly, an isopropyl group), a trifluoromethyl group and a pentafluoroethyl group can be preferably adopted.

Moreover, in the formula (3-7), "b" and "d" represent an integer of 0 to 20.

Furthermore, in the formula (3-7), "c" represents an integer of 1 to 500.

With respect to $R^{41}$ and $R^{42}$ in the formula (4), examples of the alkyl group include a methyl group, an ethyl group, a propyl group and a butyl group, examples of the alkoxy group include a methoxy group, an ethoxy group and a propoxy group, examples of the aryl group include a phenyl group and a naphthyl group, and in particular, a methyl group, an ethyl group, a methoxy group, an ethoxy group and a phenyl group can be preferably adopted.

With respect to $R^{51}$ in the formula (5), examples of the alkyl group include a methyl group, an ethyl group, a propyl group and a butyl group, examples of the alkoxy group include a methoxy group, an ethoxy group and a propoxy group, examples of the aryl group include a phenyl group and a naphthyl group, and in particular, a methyl group, an ethyl group, a methoxy group, an ethoxy group and a phenyl group can be preferably adopted.

Specific examples of the structural unit represented by the formula (1) are shown below.

(6-1)

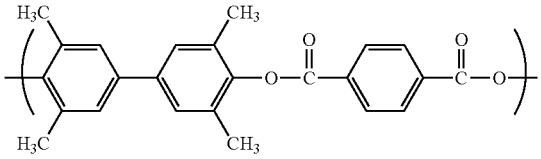

(6-2)

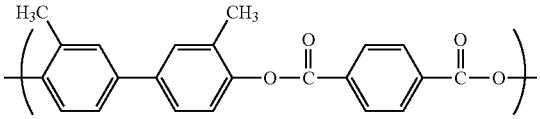

(6-3)

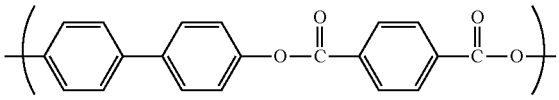

(6-4)

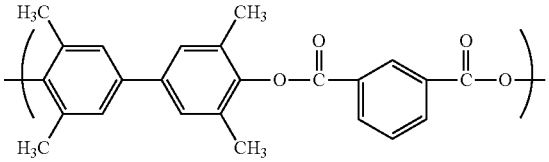

(6-5)

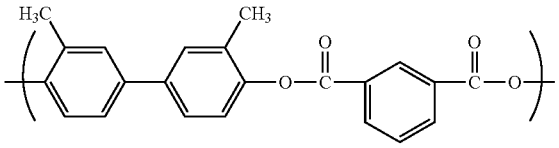

(6-6)

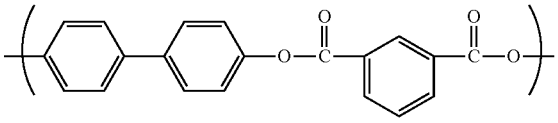

(6-7)

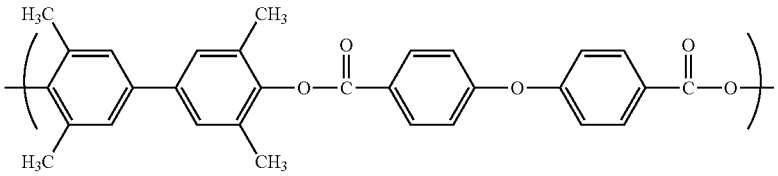

(6-8)

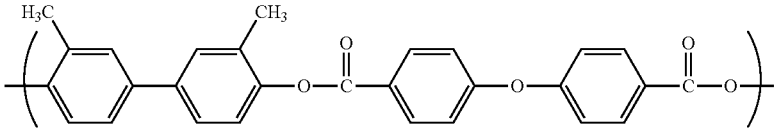

(6-9)

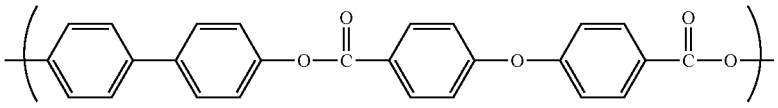

-continued (7-1)

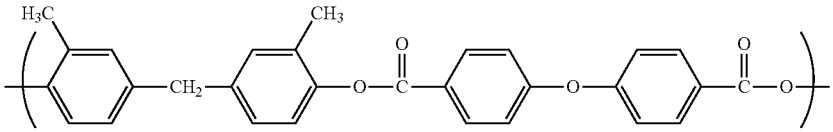

(7-2)

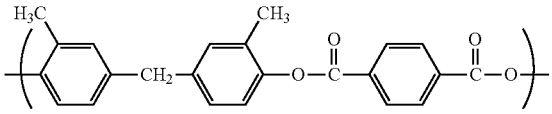

(7-3)

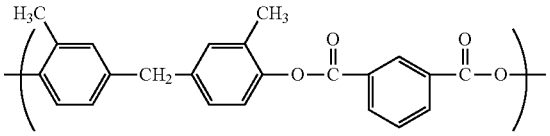

(8-1)

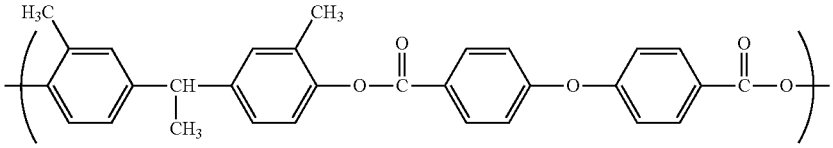

(8-2)

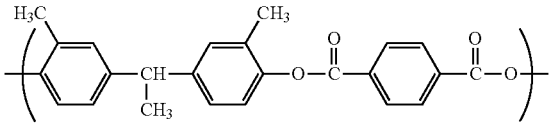

(8-3)

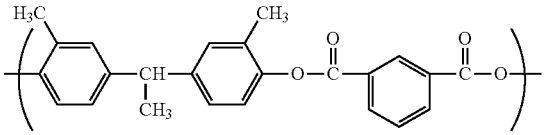

(9-1)

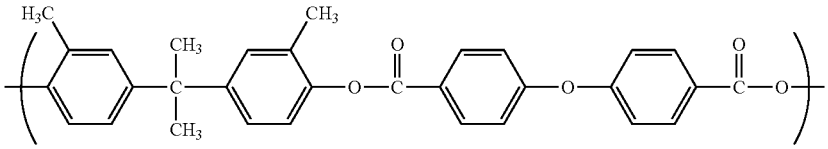

(9-2)

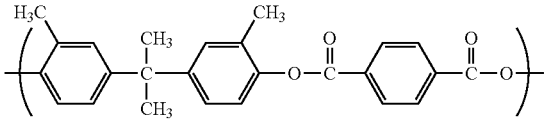

(9-3)

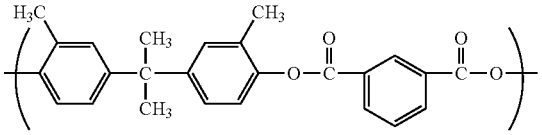

(9-4)

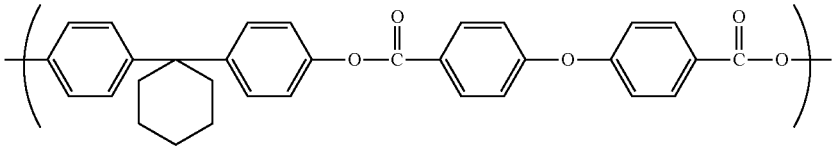

The weight average molecular weight of the polyester resin including the structural unit represented by the formula (1) is preferably 80000 or more. When the weight average molecular weight is 80000 or more, mechanical strength is high and durability of the electrophotographic photosensitive member is excellent. The weight average molecular weight is further preferably 90000 or more.

On the other hand, the weight average molecular weight of the polyester resin including the structural unit represented by the formula (1) is preferably 300000 or less. When the weight average molecular weight is 300000 or less, coatability of a coating liquid containing the polyester resin is improved. In particular, the weight average molecular weight is more preferably 200000 or less.

The polyester resin including the structural unit represented by the formula (1) can be synthesized by the transesterification method of dicarboxylate and a compound having a hydroxyl group. The polyester resin can also be synthesized by the polymerization reaction of a divalent acid halide such as dicarboxylic acid halide with a compound having a hydroxyl group, such as bisphenol. In order to produce the polyester resin in which the weight average molecular weight is in the above range, the polyester resin can be synthesized by the synthesis method using the polymerization reaction, according the latter methods.

In the present invention, the weight average molecular weight of the resin is measured, as follows, according to an ordinary method.

That is, a resin to be measured is loaded into tetrahydrofuran and left to stand for several hours, and thereafter the resin to be measured and tetrahydrofuran are well mixed under agitating (mixed until no aggregate of the resin to be measured is present), and further left to still stand for 12 hours or more.

Thereafter, the resultant is allowed to pass through a sample-treating filter Maishoridisk H-25-5 manufactured by Tosoh Corporation, and used as a sample for GPC (Gel Permeation Chromatography).

Next, a column is stabilized in a heat chamber at 40° C., tetrahydrofuran as a solvent is allowed to flow through the column at the temperature at a flow rate of 1 ml/min, 10 μl of the sample for GPC is injected, and the weight average molecular weight of the resin to be measured is measured. For the column, a column TSKgel Super HM-M manufactured by Tosoh Corporation is used.

In measurement of the weight average molecular weight of the resin to be measured, the molecular weight distribution which the resin to be measured has is calculated from the relationship between the logarithmic value of a calibration curve created using several monodisperse polystyrene standard samples, and the count number. For the standard polystyrene samples for creation of the calibration curve, 10 standard polystyrene samples in which the molecular weights of monodisperse polystyrenes are 3500, 12000, 40000, 75000, 98000, 120000, 240000, 500000, 800000 and 1800000, which are produced by Sigma-Aldrich Co., Ltd., are used. For the detector, an RI (refractive index) detector is used.

The copolymerization ratio of a resin of a copolymer, as the resin in the present invention, is confirmed by performing a conversion method in which the peak area ratio of hydrogen atoms constituting the resin is determined by $^{1}$H-NMR measurement of the resin, which is a common method.

The gallium phthalocyanine crystal of the present invention may include a plurality of organic compounds, and the content of the organic compound is 0.1% by mass or more and 1.5% by mass or less in total based on a gallium phthalocyanine in the gallium phthalocyanine crystal.

A phthalocyanine crystal is more preferable in which the content of the organic compound is 0.4% by mass or more and 1.4% by mass or less based on a gallium phthalocyanine in the gallium phthalocyanine crystal.

The organic compound is at least one compound selected from the group consisting of dimethylsulfoxide, N,N-dimethylformamide, N-methylformamide, N-propylformamide, N-vinylformamide and N-methylpyrrolidone. Furthermore, at least one amide compound selected from the group consisting of N-methylformamide, N-propylformamide and N-vinylformamide can be preferably adopted.

As the gallium phthalocyanine crystal, a hydroxygallium phthalocyanine crystal, a chlorogallium phthalocyanine crystal, a bromogallium phthalocyanine crystal and an iodogallium phthalocyanine crystal are preferable because they have an excellent sensitivity and can act effectively in the present invention. In particular, the hydroxygallium phthalocyanine crystal and the chlorogallium phthalocyanine crystal are especially preferable. The hydroxygallium phthalocyanine crystal has a hydroxy group as an axial ligand to a gallium atom. The chlorogallium phthalocyanine crystal has a chlorine atom as an axial ligand to a gallium atom. The bromogallium phthalocyanine crystal has a bromine atom as an axial ligand to a gallium atom. The iodogallium phthalocyanine crystal has an iodine atom as an axial ligand to a gallium atom.

Furthermore, the hydroxygallium phthalocyanine crystal having peaks at Bragg angles 2θ of 7.4°±0.3° and 28.3°±0.3° in X-ray diffraction with CuKα rays is more preferable, in terms of high sensitivity.

Also, the chlorogallium phthalocyanine crystal having peaks at Bragg angles 2θ±0.2° of 7.4°, 16.6°, 25.5° and 28.3° in X-ray diffraction with CuKα rays is more preferable, in terms of high sensitivity.

The method for producing the gallium phthalocyanine crystal in which the organic compound is contained is described.

The gallium phthalocyanine crystal in which the organic compound is contained, in the present invention, is obtained in a step of adding the gallium phthalocyanine to a solvent including the organic compound and subjecting the resultant to a wet milling treatment to thereby perform crystal transformation of the gallium phthalocyanine. The gallium phthalocyanine for use in the wet milling treatment can be a gallium phthalocyanine obtained by an acid pasting method or a dry milling treatment.

The wet milling treatment here conducted is, for example, a treatment conducted using a milling apparatus such as a sand mill or a ball mill together with a dispersant such as glass beads, steel beads or an alumina ball. The wet milling time can be about 30 to 3000 hours. In particular, a method can be preferably adopted in which a sample is taken every 10 to 100 hours, and the content of the organic compound in the gallium phthalocyanine crystal is confirmed by NMR measurement. The amount of the dispersant for use in the wet milling treatment can be 10 to 50 times the amount of the gallium phthalocyanine on a mass basis.

The amount of the above organic compound to be used can be 5 to 30 times the amount of the gallium phthalocyanine crystal on a mass basis.

Whether the gallium phthalocyanine crystal in the present invention contains the above organic compound in the crystal or not is determined in the present invention by subjecting the resulting gallium phthalocyanine crystal to NMR measurement.

X-ray diffraction and NMR measurements of the gallium phthalocyanine crystal contained in the electrophotographic photosensitive member of the present invention are performed under the following conditions.

(Powder X-Ray Diffraction Measurement)

Measurement machine used: X-ray diffraction apparatus RINT-TTRII manufactured by Rigaku Corporation
X-ray tube bulb: Cu
Tube voltage: 50 KV
Tube current: 300 mA
Scanning method: 2θ/θ scanning
Scanning speed: 4.0°/min
Sampling interval: 0.02°
Start angle (2θ): 5.0°
Stop angle (2θ): 40.0°
Attachment: standard specimen holder
Filter: not used
Incident monochromator: used
Counter monochromator: not used
Divergence slit: open
Vertical divergence limitation slit: 10.00 mm
Scattering slit: open
Light-receiving slit: open
Flat plate monochromator: used
Counter: scintillation counter (1H-NMR Measurement)

Measurement instrument used: AVANCEIII 500 manufactured by Bruker Corporation
Solvent: deuterosulfuric acid ($D_2SO_4$)

The photosensitive layer in the present invention is a laminated photosensitive member obtained by laminating the charge generating layer including the gallium phthalocyanine crystal in which the organic compound is contained, and the charge transporting layer including the polyester resin having the structural units represented by the formula (1). In a lamination relation of the charge generating layer and the charge transporting layer, the charge generating layer is an underlayer.

As a support for use in the present invention, the support having electro-conductivity (electro-conductive support) is preferable. Examples of the support include metals and alloys such as aluminum and stainless steel, or metals, alloys, plastics and paper provided with the electro-conductive layer. The shape of the support can be a cylindrical shape or a film shape.

In the present invention, an undercoat layer (also referred to as "intermediate layer".) having a barrier function and an adhesion function can also be provided between the support and the photosensitive layer. For the material of the undercoat layer, polyvinyl alcohol, polyethylene oxide, ethyl cellulose, methyl cellulose, casein, polyamide, glue, gelatin and the like are used. The undercoat layer can be formed by coating on the support with a coating liquid for an undercoat layer, containing the above material, to form a coating film, and drying the coating film. A metal oxide may also be added as a resistance control agent. The thickness of the undercoat layer can be 0.3 to 5.0 μm.

Furthermore, an electro-conductive layer for the purposes of covering of irregularities and defects of the support and prevention of interference fringes can be provided between the support and the undercoat layer. The electro-conductive layer can be formed by dispersing an electro-conductive particle such as carbon black, a metal particle and a metal oxide in a binder resin. The thickness of the electro-conductive layer is preferably 5 to 40 μm, particularly preferably 10 to 30 μm.

The charge generating layer can be formed by coating of a coating liquid for a charge generating layer, the coating liquid being prepared by dispersing the gallium phthalocyanine crystal, in which the organic compound is contained, and the binder resin in a solvent, and drying of the resulting coating film. The thickness of the charge generating layer is preferably 0.05 to 1 μm, more preferably 0.1 to 0.3 μm.

The content of the gallium phthalocyanine crystal containing the above organic compound, in the charge generating layer, is preferably 40% by mass or more and 85% by mass or less, more preferably 60% by mass or more and 80% by mass or less based on the total mass of the charge generating layer.

Examples of the binder resin for use in the charge generating layer include resins such as polyester, an acrylic resin, polycarbonate, polyvinyl butyral, polystyrene, polyvinyl acetate, polysulfone, an acrylonitrile copolymer and polyvinyl benzal. In particular, polyvinyl butyral or polyvinyl benzal can be preferably adopted in terms of dispersibility of the gallium phthalocyanine crystal.

The charge transporting layer can be formed by coating of a coating liquid for a charge transporting layer, in which the charge transporting material and the polyester resin including the structural units represented by the formula (1) are dissolved in a solvent, and drying of the resulting coating film. In addition, a release agent for the purpose of an increase in transfer efficiency of a toner, a fingerprint adhesion inhibitor for the purpose of prevention of contamination and the like, a filler for the purpose of prevention of abrading, and a lubricant for the purpose of an increase in lubricating property on the drum surface may also be added to the charge transporting layer.

For the solvent for use in preparation of the charge transporting layer of the electrophotographic photosensitive member according to the present invention, ketone type solvents such as acetone and methyl ethyl ketone, ester type solvents such as methyl acetate and ethyl acetate;

aromatic hydrocarbon solvents such as toluene, xylene and chlorobenzene;

ether type solvents such as 1,4-dioxane and tetrahydrofuran;

hydrocarbon solvents substituted with a halogen atom such as chloroform;

and the like are used. Such solvents may be used singly or as a mixture of two or more. Among such solvents, a solvent having a dipole moment of 1.0 D or less is preferable. The solvent having a dipole moment of 1.0 D or less includes xylene (m-xylene, o-xylene), toluene, 1,4-dioxane and dimethoxymethane, and in particular, o-xylene and dimethoxymethane are more preferable.

In formation of the charge transporting layer, such the solvent is used in combination with the polyester resin including the structural units represented by the formula (1), and the charge transporting material to thereby provide an electrophotographic photosensitive member that is excellent in coatability and that hardly causes fogging even in repeated use. The thickness of the charge transporting layer is preferably 5 to 40 μm, particularly preferably 7 to 25 μm.

The content of the charge-transporting substance is preferably 20 to 80% by mass, particularly preferably 30 to 60% by mass based on the total mass of the charge transporting layer. The charge-transporting substance includes various triarylamine compounds, hydrazone compounds, stilbene compounds, pyrazoline compounds, oxazole compounds, thiazole compounds and triallylmethane compounds. In particular, a triarylamine compound can be preferably adopted as the charge-transporting substance.

For the coating method of each of the layers, a coating method such as a dip-coating method (dipping method), a spray coating method, a spinner coating method, a bead coating method, a blade coating method and a beam coating method can be used.

FIG. 1 is a view illustrating one example of a schematic configuration of an electrophotographic apparatus provided with a process cartridge including the electrophotographic photosensitive member of the present invention.

A member 1 is a cylindrical (drum-shaped) electrophotographic photosensitive member, is rotatably driven at a predetermined peripheral speed (process speed) about a shaft 2 in the arrow direction.

The surface of the electrophotographic photosensitive member 1 is charged to a predetermined positive or negative potential by a charging unit 3 in the course of rotation. Next, the surface charged of the electrophotographic photosensitive member 1 is irradiated with image exposing light 4 from an image exposing unit (not illustrated), and an electrostatic latent image is formed according to image information intended. The image exposing light 4 is light intensity-modulated according to a time-series electric digital image signal of image information intended, the light being output from an image exposing unit such as a slit exposing unit or a laser beam scanning exposure unit.

The electrostatic latent image formed on the surface of the electrophotographic photosensitive member 1 is developed (regularly developed or reversely developed) by a toner accommodated in a developing unit 5, and a toner mage is formed on the surface of the electrophotographic photosensitive member 1. The toner image formed on the surface of the electrophotographic photosensitive member 1 is transferred on a transfer material 7 by a transfer unit 6. A bias voltage having a reverse polarity to the charge retained by the toner is here applied to the transfer unit 6 from a bias power source (not illustrated). If the transfer material 7 is paper, the transfer material 7 is taken out from a paper-feeding unit (not illustrated) and fed between the electrophotographic photosensitive member 1 and the transfer unit 6 in synchronization with the rotation of the electrophotographic photosensitive member 1.

The transfer material 7, on which the toner image is transferred from the electrophotographic photosensitive member 1, is separated from the surface of the electrophotographic photosensitive member 1, conveyed to an image-fixing unit 8, subjected to a fixing treatment of the toner image and discharged as an image forming product (print, copy) outside the electrophotographic apparatus.

The surface of the electrophotographic photosensitive member 1, from which the toner image is transferred to the transfer material 7, is cleaned by removal of an adhering substance such as a toner (transfer residual toner) by a cleaning unit 9. A cleaner-less system has also been recently developed, and the transfer residual toner can also be directly removed by a developing machine or the like. Furthermore, the surface of the electrophotographic photosensitive member 1 is subjected to an antistatic treatment by pre-exposing light 10 from a pre-exposing unit (not illustrated), and thereafter repeatedly used for image formation. Herein, when the charging unit 3 is a contact charging unit using a charging roller or the like, the pre-exposing unit is not necessarily needed.

In the present invention, a plurality of constituent elements among the constituent elements such as the electrophotographic photosensitive member 1, the charging unit 3, the developing unit 5 and the cleaning unit 9 may be accommodated in a container to be integrally supported to form a process cartridge. The process cartridge can be then configured to be detachably attachable to the main body of the electrophotographic apparatus. For example, at least one selected from the charging unit 3, the developing unit 5 and the cleaning unit 9 is integrally supported together with the electrophotographic photosensitive member 1 to form a cartridge, and the cartridge can be formed into a process cartridge 11 detachably attachable to the main body of the electrophotographic apparatus by using a guide unit 12 such as a rail of the main body of the electrophotographic apparatus.

When the electrophotographic apparatus is a copier or a printer, the image exposing light 4 may be light reflected or transmitted from an original manuscript. Alternatively, the image exposing light 4 may be light radiated by reading of the original manuscript by a sensor for conversion to signals, and scanning of a laser beam, driving of an LED array, driving of a liquid crystal shutter array, or the like performed according to the signals.

The electrophotographic photosensitive member 1 of the present invention can also be widely applied in the electrophotographic application field such as a laser beam printer, a CRT printer, an LED printer, FAX, a liquid crystal printer and laser plate making.

EXAMPLES

Hereinafter, the present invention is described with reference to specific Examples in more detail. The present invention, however, is not limited thereto. Herein, the thickness of each of the layers of the electrophotographic photosensitive member in each of Examples and Comparative Examples was determined by an eddy current type film thickness meter (Fischerscope manufactured by Fischer Instruments), or determined from the mass per unit area in terms of specific gravity. In addition, "part(s)" described below means "part(s) by mass".

Synthesis Example 1-1

Under a nitrogen flow atmosphere, 5.46 parts of phthalonitrile and 45 parts of α-chloronaphthalene were loaded to a reaction vessel and thereafter heated to a temperature of 30° C., and thereafter the temperature was kept. Next, 3.75 parts of gallium trichloride was loaded thereto at the temperature (30° C.). The moisture value of the mixed liquid in loading was 150 ppm. Thereafter, the temperature was raised to 200° C. Next, under a nitrogen flow atmosphere, the resultant was subjected to a reaction at a temperature of 200° C. for 4.5 hours and thereafter cooled, and when the temperature reached 150° C., the resultant was filtered to provide a product. The resulting filtrate was dispersed in and washed with N,N-dimethylformamide at a temperature of 140° C. for 2 hours, and thereafter the resultant was filtered. The resulting filtrate was washed with methanol, and thereafter dried to provide 4.65 parts of a chlorogallium phthalocyanine pigment (yield: 71%).

Synthesis Example 1-2

The chlorogallium phthalocyanine pigment (4.65 parts) obtained in Synthesis Example 1-1 was dissolved in 139.5 parts of concentrated sulfuric acid at a temperature of 10° C., the resulting solution was dropped in 620 parts of ice water under stirring, for reprecipitation, and filtered using a filter press. The resulting wet cake (filtrate) was dispersed in and washed with 2% ammonia water, and thereafter filtered using a filter press. Next, the resulting wet cake (filtrate) was dispersed in and washed with ion-exchange water, thereafter filtration using a filter press was repeated three times, and thereafter a hydroxygallium phthalocyanine pigment (hydrous hydroxygallium phthalocyanine pigment) having a solid content of 23% was obtained (acid pasting treatment).

Next, 6.6 kg of the resulting hydroxygallium phthalocyanine pigment (hydrous hydroxygallium phthalocyanine pigment) was dried using a Hyper-Dry dryer (product name: HD-06R, frequency (oscillation frequency): 2455 MHz±15 MHz, manufactured by Biocon (Japan) Ltd.) as follows.

The resulting hydroxygallium phthalocyanine pigment was placed on a dedicated circular plastic tray as a mass taken out from the filter press (the thickness of the hydrous cake: 4 cm or less), and far infrared rays were set to OFF and the temperature of the inner wall of the dryer was set to 50° C. Then, when irradiation with a microwave was performed, a vacuum pump and a leak valve were adjusted to adjust the degree of vacuum to 4.0 to 10.0 kPa.

In a first step, the hydroxygallium phthalocyanine pigment was irradiated with a microwave of 4.8 kW for 50 minutes, and the microwave was then turned off once and the leak valve was closed once to provide a high vacuum atmosphere of 2 kPa or less. The solid content of the hydroxygallium phthalocyanine pigment here was 88%.

In a second step, the leak valve was adjusted to adjust the degree of vacuum (the pressure in the dryer) to the setting value (4.0 to 10.0 kPa). Thereafter, the hydroxygallium phthalocyanine pigment was irradiated with a microwave of 1.2 kW for 5 minutes, and the microwave was turned off once and the leak valve was closed once to provide a high vacuum of 2 kPa or less. The second step was repeated one more time (twice in total). The solid content of the hydroxygallium phthalocyanine pigment here was 98%.

Furthermore, in a third step, irradiation with a microwave was performed in the same manner as in the second step except that the microwave in the second step was changed from 1.2 kW to 0.8 kW. The third step was repeated one more time (twice in total).

Furthermore, in a fourth step, the leak valve was adjusted to adjust the degree of vacuum (the pressure in the dryer) to the setting value (4.0 to 10.0 kPa). Thereafter, the hydroxygallium phthalocyanine pigment was irradiated with a microwave of 0.4 kW for 3 minutes, and the microwave was turned off once and the leak valve was closed once to provide a high vacuum of 2 kPa or less. The fourth step was further repeated seven times (8 times in total).

As described above, 1.52 kg of a hydroxygallium phthalocyanine pigment having a water content of 1% or less was obtained in 3 hours in total.

Synthesis Example 2-1

Hereinafter, the synthesis method of a polyester resin in which the proportion of the structural unit represented by formula (9-1) is 100% in terms of the molar ratio in all constituent units of the polyester resin is shown.

Diphenyl ether dicarboxylic acid chloride having a structure represented by formula (2-1-1) (167 parts) was dissolved in 1560 parts of dichloromethane to prepare an acid chloride solution.

(2-1-1)

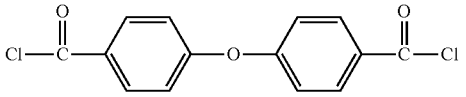

In addition, other than the acid chloride solution, 145 parts of 2,2-bis(3-methyl-4-hydroxyphenyl)propane having a structure represented by formula (2-1-2) was dissolved in 3500 parts of an aqueous 10% sodium hydroxide solution. Tributylbenzylammonium chloride (1.3 parts) was added thereto as a polymerization catalyst and stirred to prepare a 2,2-bis(3-methyl-4-hydroxyphenyl)propane solution.

(2-1-2)

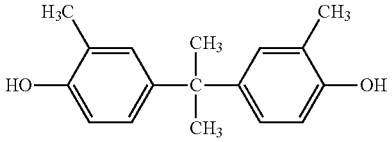

Next, the acid chloride solution was added to the 2,2-bis(3-methyl-4-hydroxyphenyl)propane solution under stirring to initiate polymerization. The polymerization was performed under stirring for 3 hours with the polymerization temperature being kept at 25° C. or lower.

Thereafter, 50 parts of acetic acid was added to the reaction thereby terminating the polymerization reaction, and washing with water was repeated until an aqueous phase was neutral.

After the washing, the resultant was dropped into methanol under stirring to precipitate a polymerized product, and the polymerized product was dried in vacuum to provide a polyester resin of the structural unit represented by formula (9-1). The weight average molecular weight in terms of polystyrene (hereinafter, designated as "weight average molecular weight (Mw)") of the polyester resin was 130000.

Synthesis Example 2-2

Hereinafter, the synthesis method of a polyester resin in which the proportion of the structural unit represented by formula (9-1) is 49%, the proportion of the structural unit represented by formula (9-2) is 21%, the proportion of the structural unit represented by formula (6-7) is 21% and the proportion of the structural unit represented by formula (6-1) is 9% in terms of the molar ratio in all constituent units of the polyester resin is shown.

Diphenyl ether dicarboxylic acid chloride having a structure represented by formula (2-1-1) (115 parts) and 34 parts of terephthalic acid chloride represented by formula (2-2-1) were dissolved in dichloromethane to prepare a mixed solution of diphenyl ether dicarboxylic acid chloride and terephthalic acid chloride.

(2-1-1)

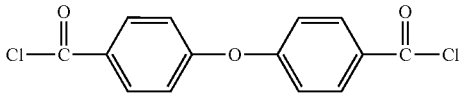

(2-2-1)

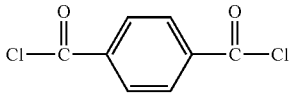

In addition, other than the acid chloride solution, 100 parts of 2,2-bis(3-methyl-4-hydroxyphenyl)propane having a structure represented by formula (2-1-2) and 40.5 parts of tetramethylbiphenol represented by formula (2-2-2) were dissolved in an aqueous 10% sodium hydroxide solution. Tributylbenzylammonium chloride was added thereto as a polymerization catalyst and stirred to prepare a mixed solution of 2,2-bis(3-methyl-4-hydroxyphenyl)propane and tetramethylbiphenol.

(2-1-2)

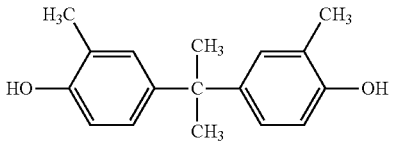

(2-2-2)

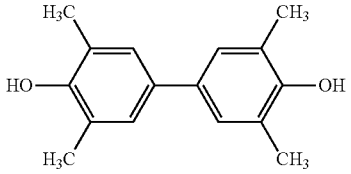

Next, the acid chloride solution was added to the mixed solution of 2,2-bis(3-methyl-4-hydroxyphenyl)propane and tetramethylbiphenol under stirring to initiate polymerization. The polymerization was performed under stirring for 3 hours with the polymerization temperature being kept at 25° C. or lower.

Thereafter, acetic acid was added to the reaction thereby terminating the polymerization reaction, and washing with water was repeated until an aqueous phase was neutral.

After the washing, the resultant was dropped into methanol under stirring to precipitate a polymerized product. The polymerized product was dried in vacuum to provide a polyester resin in which the proportion of the structural unit represented by formula (9-1) was 49%, the proportion of the structural unit represented by formula (9-2) was 21%, the proportion of the structural unit represented by formula (6-7) was 21% and the proportion of the structural unit represented by formula (6-1) was 9% in terms of the molar ratio in all constituent units of the polyester resin. The weight average molecular weight (Mw) of the polyester resin was 130000.

Synthesis Example 2-3

Hereinafter, the synthesis method of a polyester resin in which the proportion of the structural unit represented by formula (9-1) is 73% and the proportion of the structural unit represented by formula (9-3) is 23% in terms of the molar ratio in all constituent units of the polyester resin is shown as Synthesis Example.

Diphenyl ether dicarboxylic acid chloride having a structure represented by formula (2-1-1) (120 parts) and 30.5 parts of isophthalic acid chloride represented by formula (2-3-1) were dissolved in dichloromethane to prepare a mixed solution of diphenyl ether dicarboxylic acid chloride and isophthalic acid chloride.

(2-1-1)

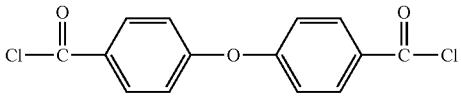

(2-3-1)

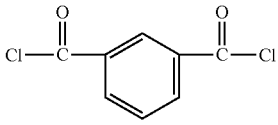

In addition, other than the acid chloride solution, 143 parts of 2,2-bis(3-methyl-4-hydroxyphenyl)propane having a structure represented by formula (2-1-2) was dissolved in an aqueous 10% sodium hydroxide solution. Tributylbenzylammonium chloride was added thereto as a polymerization catalyst and stirred to prepare a 2,2-bis(3-methyl-4-hydroxyphenyl)propane solution.

(2-1-2)

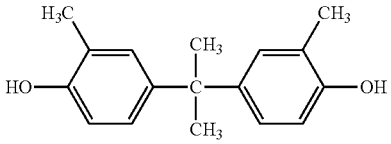

Next, the acid chloride solution was added to the 2,2-bis(3-methyl-4-hydroxyphenyl)propane solution under stirring to initiate polymerization. The polymerization was performed under stirring for 3 hours with the polymerization temperature being kept at 25° C. or lower.

Thereafter, acetic acid was added to the reaction thereby terminating the polymerization reaction, and washing with water was repeated until an aqueous phase was neutral.

After the washing, the resultant was dropped into methanol under stirring to precipitate a polymerized product. The polymerized product was dried in vacuum to provide a polyester resin in which the proportion of the structural unit represented by formula (9-1) was 73% and the proportion of the structural unit represented by formula (9-3) was 23% in terms of the molar ratio in all constituent units of the polyester resin. The weight average molecular weight (Mw) of the polyester resin was 120000.

Synthesis Example 2-4

Hereinafter, the synthesis method of a polyester resin in which the proportion of the structural unit represented by formula (9-2) is 35%, the proportion of the structural unit represented by formula (9-3) is 35%, the proportion of the structural unit represented by formula (6-1) is 15% and the proportion of the structural unit represented by formula (6-4) is 15% in terms of the molar ratio in all constituent units of the polyester resin is shown.

Terephthalic acid chloride having a structure represented by formula (2-2-1) (56.5 parts) and 56.5 parts of isophthalic acid chloride represented by formula (2-3-1) were dissolved in dichloromethane to prepare a mixed solution of terephthalic acid chloride and isophthalic acid chloride.

(2-2-1)

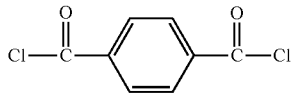

(2-3-1)

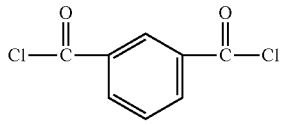

In addition, other than the acid chloride solution, 100 parts of 2,2-bis(3-methyl-4-hydroxyphenyl)propane having a structure represented by formula (2-1-2) and 40.5 parts of tetramethylbiphenol represented by formula (2-2-2) were dissolved in an aqueous 10% sodium hydroxide solution. Tributylbenzylammonium chloride was added thereto as a polymerization catalyst and stirred to prepare a mixed solution of 2,2-bis(3-methyl-4-hydroxyphenyl)propane and tetramethylbiphenol.

(2-1-2)

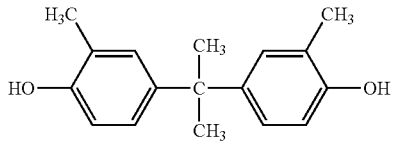

(2-2-2)

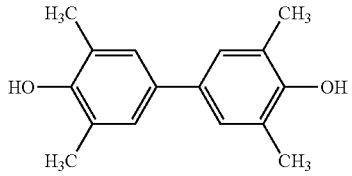

Next, the acid chloride solution was added to the mixed solution of 2,2-bis(3-methyl-4-hydroxyphenyl)propane and tetramethylbiphenol under stirring to initiate polymerization. The polymerization was performed under stirring for 3 hours with the polymerization temperature being kept at 25° C. or lower.

Thereafter, acetic acid was added to the reaction thereby terminating the polymerization reaction, and washing with water was repeated until an aqueous phase was neutral.

After the washing, the resultant was dropped into methanol under stirring to precipitate a polymerized product. The polymerized product was dried in vacuum to provide a polyester resin in which the proportion of the structural unit represented by formula (9-2) was 35%, the proportion of the structural unit represented by formula (9-3) was 35%, the proportion of the structural unit represented by formula (6-1) was 15% and the proportion of the structural unit represented by formula (6-4) was 15% in terms of the molar ratio in all constituent units of the polyester resin. The weight average molecular weight (Mw) of the polyester resin was 140000.

Synthesis Example 2-5

Hereinafter, the synthesis method of a polyester resin in which the proportion of the structural unit represented by formula (6-1) was 50% and the proportion of the structural unit represented by formula (6-4) was 50% in terms of the molar ratio in all constituent units of the polyester resin is shown.

Terephthalic acid chloride having a structure represented by formula (2-2-1) (57 parts) and 57 parts of isophthalic acid chloride represented by formula (2-3-1) were dissolved in dichloromethane to prepare a mixed solution of terephthalic acid chloride and isophthalic acid chloride.

(2-2-1)

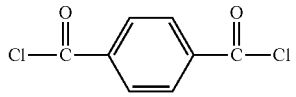

(2-3-1)

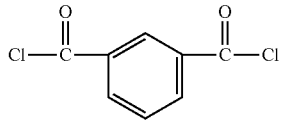

In addition, other than the acid chloride solution, 144 parts of 2,2-bis(3-methyl-4-hydroxyphenyl)propane having a structure represented by formula (2-1-2) was dissolved in an aqueous 10% sodium hydroxide solution. Tributylbenzylammonium chloride was added thereto as a polymerization catalyst and stirred to prepare a mixed solution of 2,2-bis(3-methyl-4-hydroxyphenyl)propane and tetramethylbiphenol.

(2-1-2)

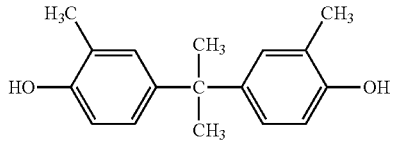

Next, the acid chloride solution was added to the mixed solution of 2,2-bis(3-methyl-4-hydroxyphenyl)propane and tetramethylbiphenol under stirring to initiate polymerization. The polymerization was performed under stirring for 3 hours with the polymerization temperature being kept at 25° C. or lower.

Thereafter, acetic acid was added to the reaction thereby terminating the polymerization reaction, and washing with water was repeated until an aqueous phase was neutral.

After the washing, the resultant was dropped into methanol under stirring to precipitate a polymerized product. The polymerized product was dried in vacuum to provide a polyester resin in which the proportion of the structural unit represented by formula (6-1) was 50% and the proportion of the structural unit represented by formula (6-4) was 50% in terms of the molar ratio in all constituent units of the polyester resin. The weight average molecular weight (Mw) of the polyester resin was 110000.

Example 1-1

Figure 2:
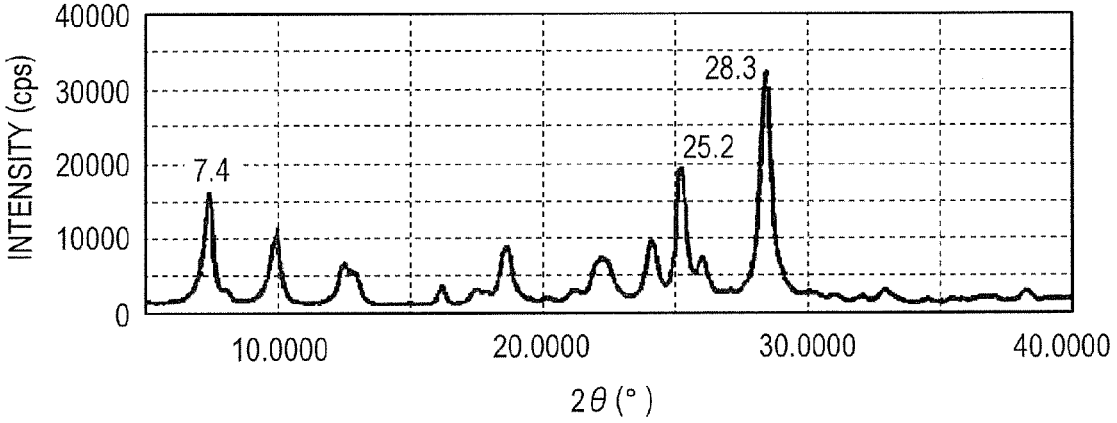
FIG. 2 is a powder X-ray diffraction diagram of a hydroxygallium phthalocyanine crystal obtained in Example 1-1.

The hydroxygallium phthalocyanine (0.5 parts) obtained in Synthesis Example 1-2 and 10 parts of N,N-dimethylformamide were subjected to a wet milling treatment by a ball mill together with 20 parts of glass beads having a diameter of 0.8 mm under conditions of room temperature (23° C.) and 120 rpm for 400 hours. A hydroxygallium phthalocyanine crystal was taken out from such a dispersion by using N,N-dimethylformamide, and filtration was conducted and a filter was sufficiently washed with tetrahydrofuran. A product taken out by filtration was dried under vacuum to provide 0.45 parts of a hydroxygallium phthalocyanine crystal. The powder X-ray diffraction diagram of the resulting crystal is illustrated in FIG. 2.

It was confirmed by NMR measurement that the content of N,N-dimethylformamide relative to the hydroxygallium phthalocyanine in the hydroxygallium phthalocyanine crystal obtained in Example 1-1 was 1.4% by mass in terms of the ratio of proton. It can be seen that N,N-dimethylformamide is contained in the crystal because it is compatible with tetrahydrofuran and therefore.

Example 1-2

Except that the wet milling treatment time was changed from 400 hours to 2000 hours in Example 1-1, the same treatment as in Example 1-1 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N,N-dimethylformamide relative to the hydroxygallium phthalocyanine in the hydroxygallium phthalocyanine crystal obtained in Example 2-1 was 0.8% by mass in terms of the ratio of proton.

Example 1-3

Except that 10 parts of N,N-dimethylformamide was changed to 10 parts of dimethylsulfoxide and the wet milling treatment time was changed from 400 hours to 300 hours in Example 1-1, the same treatment as in Example 1-1 was performed to provide 0.40 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of dimethylsulfoxide relative to the hydroxygallium phthalocyanine in the hydroxygallium phthalocyanine crystal obtained in Example 1-3 was 1.5% by mass in terms of the ratio of proton.

Example 1-4

Except that the wet milling treatment time was changed from 300 hours to 2000 hours in Example 1-3, the same treatment as in Example 1-3 was performed to provide 0.39 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of dimethylsulfoxide relative to the hydroxygallium phthalocyanine in the hydroxygallium phthalocyanine crystal obtained in Example 1-4 was 0.7% by mass in terms of the ratio of proton.

Example 1-5

Except that 10 parts of N,N-dimethylformamide was changed to 10 parts of N-methylformamide and the wet milling treatment time was changed from 400 hours to 200 hours in Example 1-1, the same treatment was performed as in Example 1-1 to provide 0.45 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of N-methylformamide relative to the hydroxygallium phthalocyanine in the hydroxygallium phthalocyanine crystal obtained in Example 1-5 was 1.2% by mass in terms of the ratio of proton.

Example 1-6

Except that the milling treatment time was changed from 200 hours to 1000 hours in Example 1-5, the same treatment as in Example 1-5 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-methylformamide relative to the hydroxygallium phthalocyanine in the hydroxygallium phthalocyanine crystal obtained in Example 1-6 was 0.5% by mass in terms of the ratio of proton.

Example 1-7

Except that 10 parts of N,N-dimethylformamide was changed to 10 parts of N-n-propylformamide and the wet milling treatment time was changed from 400 hours to 350 hours in Example 1-1, the same treatment as in Example 1-1 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of N-n-propylformamide relative to the hydroxygallium phthalocyanine in the hydroxygallium phthalocyanine crystal obtained in Example 1-7 was 1.5% by mass in terms of the ratio of proton.

Example 1-8

Except that the wet milling treatment time was changed from 350 hours to 1000 hours in Example 1-7, the same treatment as in Example 1-7 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-n-propylformamide relative to the hydroxygallium phthalocyanine in the hydroxygallium phthalocyanine crystal obtained in Example 1-8 was 0.9% by mass in terms of the ratio of proton.

Example 1-9

Except that 10 parts of N,N-dimethylformamide was changed to 10 parts of N-vinylformamide and the wet milling treatment time was changed from 400 hours to 1000 hours in Example 1-1, the same treatment as in Example 1-1 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of N-vinylformamide relative to the hydroxygallium phthalocyanine in the hydroxygallium phthalocyanine crystal obtained in Example 1-9 was 1.2% by mass in terms of the ratio of proton.

Example 1-10

Except that the wet milling treatment time was changed from 1000 hours to 600 hours in Example 1-9, the same treatment as in Example 1-9 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-vinylformamide relative to the hydroxygallium phthalocyanine in the hydroxygallium phthalocyanine crystal obtained in Example 1-10 was 1.5% by mass in terms of the ratio of proton.

Example 1-11

Except that 10 parts of N,N-dimethylformamide was changed to 10 parts of N-methyl-2-pyrrolidone and the wet milling treatment time was changed from 400 hours to 800 hours in Example 1-1, the same treatment as in Example 1-1 was performed to provide 0.44 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of N-methyl-2-pyrrolidone relative to the hydroxygallium phthalocyanine in the hydroxygallium phthalocyanine crystal obtained in Example 1-11 was 1.4% by mass in terms of the ratio of proton.

Example 1-12

Figure 3:
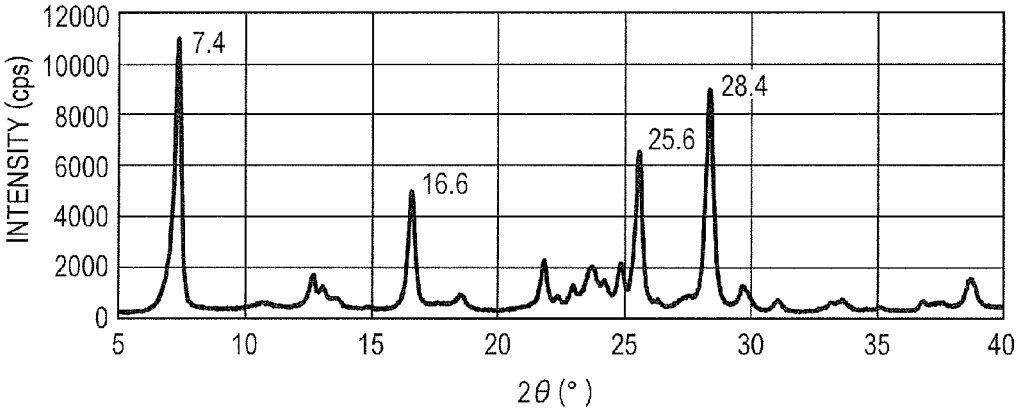
FIG. 3 is a powder X-ray diffraction diagram of a chlorogallium phthalocyanine crystal obtained in Example 1-12.

The chlorogallium phthalocyanine pigment (0.5 parts) obtained in Synthesis Example 1 was subjected to a dry milling treatment by a ball mill together with 20 parts of glass beads having a diameter of 0.8 mm at room temperature (23° C.) for 40 hours. Ten parts of N,N-dimethylformamide was added thereto and subjected to a wet milling treatment at room temperature (23° C.) for 100 hours. A chlorogallium phthalocyanine crystal was taken out from the resulting dispersion by using N,N-dimethylformamide, and filtration was conducted and a filter was sufficiently washed with tetrahydrofuran. A product taken out by filtration was dried under vacuum to provide 0.44 parts of a chlorogallium phthalocyanine crystal. The powder X-ray diffraction diagram of the resulting crystal is illustrated in FIG. 3.

It was confirmed by NMR measurement that the content of N,N-dimethylformamide relative to the chlorogallium phthalocyanine in the chlorogallium phthalocyanine crystal obtained in Example 1-12 was 1.0% by mass in terms of the ratio of proton.

Example 1-13

Except that 10 parts of N,N-dimethylformamide was changed to 10 parts of N-methylformamide in Example 1-12, the same treatment as in Example 1-12 was performed to provide 0.45 parts of a chlorogallium phthalocyanine crystal. The powder X-ray diffraction of the resulting chlorogallium phthalocyanine crystal was the same as the powder X-ray diffraction illustrated in FIG. 3.

It was confirmed by NMR measurement that the content of N-methylformamide relative to the chlorogallium phthalocyanine in the chlorogallium phthalocyanine crystal obtained in Example 1-13 was 1.5% by mass in terms of the ratio of proton.

Comparative Example 1-1

Except that the wet milling treatment time was changed from 400 hours to 48 hours in Example 1-1, the same treatment as in Example 1-1 was performed to provide 0.46 parts of a hydroxygallium phthalocyanine crystal.

It was confirmed by NMR measurement that the content of N,N-dimethylformamide relative to the hydroxygallium phthalocyanine in the hydroxygallium phthalocyanine crystal obtained in Comparative Example 1-1 was 2.1% by mass in terms of the ratio of proton.

Comparative Example 1-2

Except that the wet milling treatment time was changed from 300 hours to 48 hours in Example 1-3, the same treatment as in Example 1-3 was performed to provide 0.41 parts of a hydroxygallium phthalocyanine crystal.

It was confirmed by NMR measurement that the content of dimethylsulfoxide relative to the hydroxygallium phthalocyanine in the hydroxygallium phthalocyanine crystal obtained in Comparative Example 1-2 was 2.1% by mass in terms of the ratio of proton.

Comparative Example 1-3

Except that the wet milling treatment time was changed from 800 hours to 48 hours in Example 1-11, the same treatment as in Example 1-11 was performed to provide 0.44 parts of a hydroxygallium phthalocyanine crystal.

It was confirmed by NMR measurement that the content of N-methyl-2-pyrrolidone relative to the hydroxygallium phthalocyanine in the hydroxygallium phthalocyanine crystal obtained in Comparative Example 1-3 was 3.0% by mass in terms of the ratio of proton.

Example 2-1

Sixty parts of a barium sulfate particle covered with tin oxide (product name: Pastolan PC1, produced by Mitsui Mining & Smelting Co., Ltd.), 15 parts of a titanium oxide particle (product name: TITANIX JR, produced by Tayca), 43 parts of a resol type phenol resin (product name: Phenolite J-325, produced by DIC Corporation, solid content: 70% by mass), 0.015 parts of a silicone oil (product name: SH28PA, produced by Dow Corning Toray Silicone Co., Ltd.), 3.6 parts of a silicone resin (product name: Tospearl 120, produced by Toshiba Silicone Co., Ltd.), 50 parts of 2-methoxy-1-propanol and 50 parts of methanol were subjected to a dispersing treatment by a ball mill for 20 hours to thereby prepare a coating liquid for an electro-conductive layer.

An alumina cylinder as the support was dip-coated with the coating liquid for an electro-conductive layer, and the resulting coating film was dried at 140° C. for 30 minutes to thereby form an electro-conductive layer having a thickness of 15 μm.

Next, 10 parts of a copolymerized nylon resin (product name: Amilan CM8000, produced by Toray Industries Inc.) and 30 parts of a methoxymethylated 6 nylon resin (product name: Tresin EF-30T, produced by Teikoku Chemical Industries Co., Ltd.) were dissolved in a mixed solvent of 400 parts of methanol/200 parts of n-butanol to thereby prepare a coating liquid for an undercoat layer.

The electro-conductive layer was dip-coated with the coating liquid for an undercoat layer, and the resulting coating film was dried to thereby form an undercoat layer having a thickness of 0.7 μm.

Next, 10 parts of the hydroxygallium phthalocyanine crystal (charge-generating substance) obtained in Example 1-1, 5 parts of polyvinyl butyral (product name: S-LEC BX-1, produced by Sekisui Chemical Co., Ltd.) and 250 parts of cyclohexanone were loaded in a sand mill using glass beads having a diameter of 1 mm and subjected to a dispersing treatment for 6 hours, and 250 parts of ethyl acetate was added thereto for diluting to thereby prepare a coating liquid for a charge generating layer.

The undercoat layer was dip-coated with the coating liquid for a charge generating layer, and the resulting coating film was dried at 100° C. for 10 minutes to thereby form a charge generating layer having a thickness of 0.22 μm.

Next, 6 parts of a compound (charge transporting material) represented by formula (CTM-1), 3 parts of a compound (charge transporting material) represented by formula (CTM-2) and 10 parts of the polyester resin obtained in Synthesis Example 2-1 were dissolved in 70 parts of tetrahydrofuran (dipole moment: 1.63 D) and 20 parts of toluene (dipole moment: 0.36 D) to thereby prepare a coating liquid for a charge transporting layer.

(CTM-1)

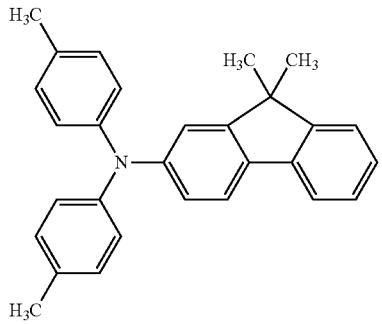

-continued (CTM-2)

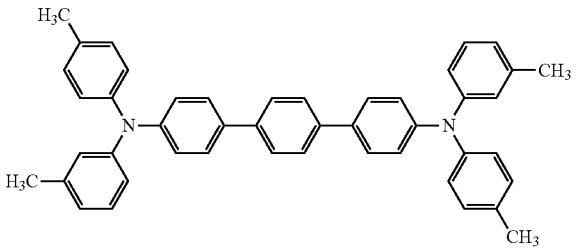

The charge generating layer was dip-coated with the coating liquid for a charge transporting layer, and the resulting coating film was dried at 125° C. for 1 hour to thereby form a charge transporting layer having a thickness of 15.5 μm.

Thus, a cylindrical (drum-shaped) electrophotographic photosensitive member of Example 2-1 was produced.

Example 2-2

Except that the hydroxygallium phthalocyanine crystal obtained in Example 1-1 in preparation of the coating liquid for a charge generating layer was changed to the hydroxygallium phthalocyanine crystal obtained in Example 1-2 and furthermore the polyester resin in preparation of the coating liquid for a charge transporting layer was changed from the resin obtained in Synthesis Example 2-1 to the resin obtained in Synthesis Example 2-4, the same manner as in Example 2-1 was performed to produce an electrophotographic photosensitive member in Example 2-2.

Example 2-3

Except that the hydroxygallium phthalocyanine crystal obtained in Example 1-1 in preparation of the coating liquid for a charge generating layer was changed to the hydroxygallium phthalocyanine crystal obtained in Example 1-3 and furthermore the polyester resin in preparation of the coating liquid for a charge transporting layer was changed from the resin obtained in Synthesis Example 2-1 to the resin obtained in Synthesis Example 2-3, the same manner as in Example 2-1 was performed to produce an electrophotographic photosensitive member in Example 2-3.

Example 2-4

Except that the hydroxygallium phthalocyanine crystal obtained in Example 1-2 in preparation of the coating liquid for a charge generating layer was changed to the hydroxygallium phthalocyanine crystal obtained in Example 1-4, the same manner as in Example 2-2 was performed to produce an electrophotographic photosensitive member of Example 2-4.

Example 2-5

Except that the hydroxygallium phthalocyanine crystal obtained in Example 1-1 in preparation of the coating liquid for a charge generating layer was changed to the hydroxygallium phthalocyanine crystal obtained in Example 1-5 and furthermore the polyester resin in preparation of the coating liquid for a charge transporting layer was changed from the resin obtained in Synthesis Example 2-1 to the resin obtained in Synthesis Example 2-2 and the solvent was changed from tetrahydrofuran to o-xylene (dipole moment: 0.64 D) and from toluene to dimethoxymethane (dipole moment: 0.99 D), the same manner as in Example 2-1 was performed to produce an electrophotographic photosensitive member in Example 2-5.

Example 2-6

Except that the hydroxygallium phthalocyanine crystal obtained in Example 1-5 in preparation of the coating liquid for a charge generating layer was changed to the hydroxygallium crystal obtained in Example 1-6 and furthermore the polyester resin in preparation of the coating liquid for a charge transporting layer was changed from the resin obtained in Synthesis Example 2-2 to the resin obtained in Synthesis Example 2-1, the same manner as in Example 2-5 was performed to produce an electrophotographic photosensitive member in Example 2-6.

Example 2-7

Except that the hydroxygallium phthalocyanine crystal obtained in Example 1-1 in preparation of the coating liquid for a charge generating layer was changed to the hydroxygallium phthalocyanine crystal obtained in Example 1-7 and furthermore the polyester resin in preparation of the coating liquid for a charge transporting layer was changed from the resin obtained in Synthesis Example 2-1 to the resin obtained in Synthesis Example 2-5, the same manner as in Example 2-1 was performed to produce an electrophotographic photosensitive member in Example 2-7.

Example 2-8

Except that the hydroxygallium phthalocyanine crystal obtained in Example 1-1 in preparation of the coating liquid for a charge generating layer was changed to the hydroxygallium phthalocyanine crystal obtained in Example 1-8 and furthermore the resin in preparation of the coating liquid for a charge transporting layer was changed from 10 parts of the resin obtained in Synthesis Example 2-2 to 7 parts of the resin obtained in Synthesis Example 2-2, 2 parts of polycarbonate A type resin, and 1 part of polycarbonate C type resin, the same manner as in Example 2-5 was performed to produce an electrophotographic photosensitive member in Example 2-8.

Example 2-9

Except that the hydroxygallium phthalocyanine crystal obtained in Example 1-1 in preparation of the coating liquid for a charge generating layer was changed to the hydroxygallium phthalocyanine crystal obtained in Example 1-9, the same manner as in Example 2-7 was performed to produce an electrophotographic photosensitive member in Example 2-9.

Example 2-10

Except that the hydroxygallium phthalocyanine crystal obtained in Example 1-1, in preparation of the coating liquid for a charge generating layer, was changed to the hydroxygallium crystal obtained in Example 1-10 and furthermore the polyester resin in preparation of the coating liquid for a charge transporting layer was changed from the resin obtained in Synthesis Example 2-2 to the resin obtained in Synthesis Example 2-4 and 0.1 parts of a lubricant represented by formula (PcSi-1) was added, the same manner as in Example 2-5 was performed to produce an electrophotographic photosensitive member in Example 2-10.

(PcSi-1)

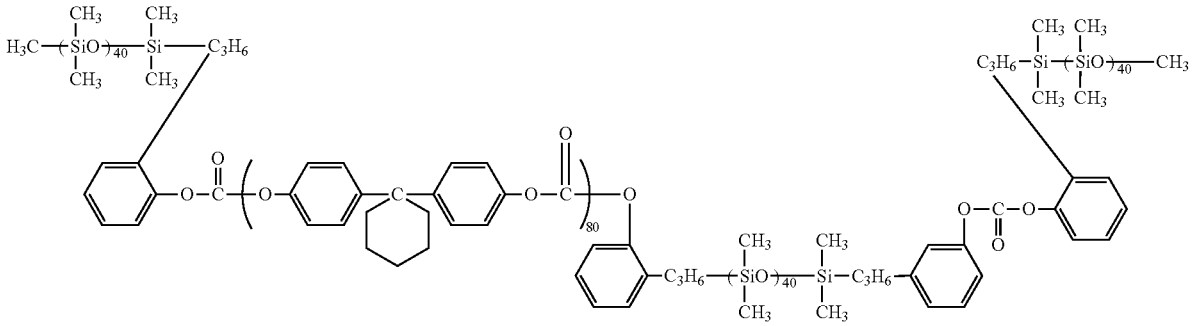

Example 2-11

Except that the hydroxygallium phthalocyanine crystal obtained in Example 1-1 in preparation of the coating liquid for a charge generating layer was changed to the hydroxygallium phthalocyanine crystal obtained in Example 1-11 and furthermore the polyester resin in preparation of the coating liquid for a charge transporting layer was changed from the resin obtained in Synthesis Example 2-2 to the resin obtained in Synthesis Example 2-5, the same manner as in Example 2-5 was performed to produce an electrophotographic photosensitive member in Example 2-11.

Example 2-12

Except that the hydroxygallium phthalocyanine crystal obtained in Example 1-1 in preparation of the coating liquid for a charge generating layer was changed to the chlorogallium phthalocyanine crystal obtained in Example 1-12 and furthermore the polyester resin in preparation of the coating liquid for a charge transporting layer was changed from the resin obtained in Synthesis Example 2-1 to the resin obtained in Synthesis Example 2-5, the same manner as in Example 2-1 was performed to produce an electrophotographic photosensitive member in Example 2-12.

Example 2-13

Except that the hydroxygallium phthalocyanine crystal obtained in Example 1-1 in preparation of the coating liquid for a charge generating layer was changed to the chlorogallium phthalocyanine crystal obtained in Example 1-13 and furthermore the resin in preparation of the coating liquid for a charge transporting layer was changed from 10 parts of the resin obtained in Synthesis Example 2-2 to 5 parts of polyarylate resin (product name: U-Polymer, produced by Unitika Ltd.), 5 parts of polycarbonate Z type resin (product name: Iupilon, produced by Mitsubishi Engineering-Plastics Corporation), the same manner as in Example 2-5 was performed to produce an electrophotographic photosensitive member in Example 2-13. Herein, U-Polymer was a poly 4,4'-isopropylidenediphenylene terephthalate/isophthalate copolymer, and was a polyester resin having the structural unit represented by formula (1).

Comparative Example 2-1

Except that the hydroxygallium phthalocyanine crystal obtained in Example 1-1 in preparation of the coating liquid for a charge generating layer was changed to the hydroxygallium phthalocyanine crystal obtained in Comparative Example 1-1 and furthermore the polyester resin obtained in Synthesis Example 2-1 in preparation of the coating liquid for a charge transporting layer was changed to comparative compound 1, the same manner as in Example 2-1 was performed to produce an electrophotographic photosensitive member of Comparative Example 2-1.

comparative compound 1

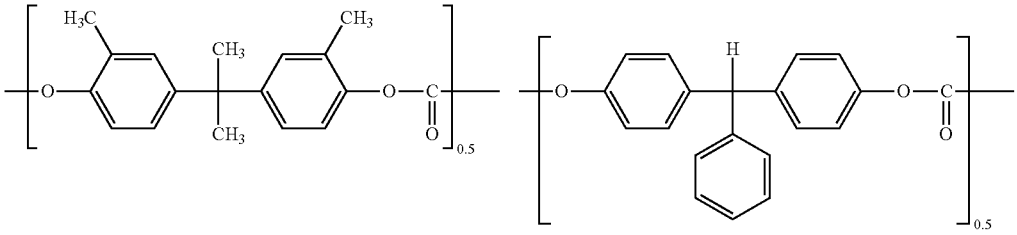

Comparative Example 2-2

Except that the hydroxygallium phthalocyanine crystal obtained in Example 1-1 in preparation of the coating liquid for a charge generating layer was changed to the hydroxygallium phthalocyanine crystal obtained in Comparative Example 1-2 and furthermore the polyester resin obtained in Synthesis Example 2-1 in preparation of the coating liquid for a charge transporting layer was changed to comparative compound 1, the same manner as in Example 2-1 was performed to produce an electrophotographic photosensitive member in Comparative Example 2-2.

Comparative Example 2-3

Except that the hydroxygallium phthalocyanine crystal obtained in Example 1-1 in preparation of the coating liquid for a charge generating layer was changed to the hydroxygallium phthalocyanine crystal obtained in Comparative Example 1-3 and furthermore the polyester resin obtained in Synthesis Example 2-1 in preparation of the coating liquid for a charge transporting layer was changed to comparative compound 1, the same manner as in Example 2-1 was performed to produce an electrophotographic photosensitive member in Comparative Example 2-3.

Comparative Example 2-4

Except that the polyester resin obtained in Synthesis Example 2-3, in preparation of the coating liquid for a charge transporting layer, was changed to comparative compound 1, the same manner as in Example 2-3 was performed to produce an electrophotographic photosensitive member in Comparative Example 2-4.

Comparative Example 2-5

Except that the hydroxygallium phthalocyanine crystal obtained in Example 1-1 in preparation of the coating liquid for a charge generating layer was changed to the hydroxygallium phthalocyanine crystal obtained in Comparative Example 1-2 and furthermore the polyester resin obtained in Synthesis Example 2-1, in preparation of the coating liquid for a charge transporting layer, was changed to a polyarylate resin (product name: U-Polymer, produced by Unitika Ltd.), the same manner as in Example 2-1 was performed to produce an electrophotographic photosensitive member in Comparative Example 2-5.

Comparative Example 2-6

Except that the polyester resin obtained in Synthesis Example 2-5, in preparation of the coating liquid for a charge transporting layer, was changed to comparative compound 1, the same manner as in Example 2-11 was performed to produce an electrophotographic photosensitive member in Comparative Example 2-6.

Evaluation of Examples 2-1 to 2-13 and Comparative Examples 2-1 to 2-6

The electrophotographic photosensitive member in each of Examples 2-1 to 2-13 and Comparative Examples 2-1 to 2-6 was evaluated with respect to fogging in an image output after repeated use for 10,000 sheets.

A laser beam printer CP-4525 manufactured by Hewlett-Packard Development Company, L.P. was altered so as to enable to adjust the charging potential (dark portion potential) of the electrophotographic photosensitive member, and was used as an evaluation apparatus with the dark portion potential being set at −450 V. The evaluation was performed under an environment of a temperature of 23° C. and a relative humidity of 50%.

<Fogging Evaluation>

An image of a test chart having a printing rate of 4% was output on A4 size plain paper for 10,000 sheets, thereafter a white solid image was output, and the image rank evaluation with respect to fogging was performed. The resulting image was ranked AA, A, B, C, D, E, F or G. Rank AA means the highest level. Ranks A to D were determined to be at a level where the effect of the present invention was exerted. The evaluation results in Examples and Comparative Examples are shown in Table 1.

TABLE 1

| | Rank after endurance |
|---|---|
| Example 2-1 | C |
| Example 2-2 | B |
| Example 2-3 | D |
| Example 2-4 | B |
| Example 2-5 | A |
| Example 2-6 | AA |
| Example 2-7 | B |
| Example 2-8 | A |
| Example 2-9 | B |
| Example 2-10 | B |
| Example 2-11 | A |
| Example 2-12 | B |
| Example 2-13 | A |
| Comparative Example 2-1 | F |
| Comparative Example 2-2 | F |
| Comparative Example 2-3 | G |
| Comparative Example 2-4 | G |
| Comparative Example 2-5 | F |
| Comparative Example 2-6 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234939, filed Nov. 19, 2014, and Japanese Patent Application No. 2015-211937, filed Oct. 28, 2015, which are hereby incorporated by reference herein in their entirety.

What is claimed is:

1. An electrophotographic photosensitive member comprising:

a support; and a charge generating layer and a charge transporting layer on the support, wherein the charge generating layer comprises:

a gallium phthalocyanine crystal in which an organic compound is contained, wherein the organic compound is at least one compound selected from the group consisting of N-methylformamide, N-propylformamide, and N-vinylformamide, the content of the organic compound is 0.1% by mass or more and 1.5% by mass or less based on a gallium phthalocyanine in the gallium phthalocyanine crystal, and the charge transporting layer comprises a polyester resin having a structural unit represented by formula (1), $$\text{-}(\text{A-B})\text{-} \quad (1)$$

wherein, in the formula (1),

"A" represents a divalent group represented by formula (2), and

"B" represents a divalent group represented by formulae (4), (11) or (12), (2)

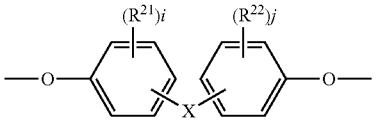

wherein, in the formula (2), $R^{21}$ and $R^{22}$ each independently represent an alkyl group, an aryl group or an alkoxy group, and i and j each independently represent an integer of 0 to 4; and in the formula (2), X represents a group represented by any of formulae (3-1) to (3-7):

(3-1)

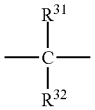

(3-2)

(3-3)

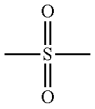

(3-4)

(3-5)

(3-6)

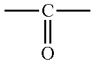

(3-7)

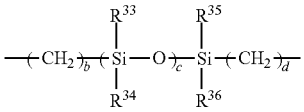

wherein, in the formula (3-1), $R^{31}$ and $R^{32}$ represent a hydrogen atom, a halogen atom, a substituted or unsubstituted alkyl group, a substituted or unsubstituted aryl group, a substituted or unsubstituted alkenyl group, or a group required to form a cycloalkyl ring or a heterocyclic ring by bonding of $R^{31}$ and $R^{32}$; in the formula (3-7), $R^{33}$ to $R^{36}$ each independently represent a hydrogen atom, a substituted or unsubstituted alkyl group, or a substituted or unsubstituted aryl group; and in the formula (3-4) and in the formula (3-7), "a" and "b" and "d" represent an integer of 0 to 20, and "c" represents an integer of 1 to 500;

(4)

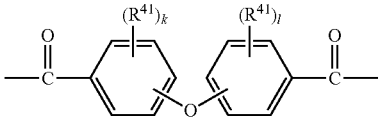

wherein, in the formula (4), $R^{41}$ and $R^{42}$ each independently represent an alkyl group, an aryl group or an alkoxy group, and "k" and "l" each independently represent an integer of 0 to 4; and (11)

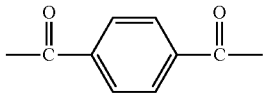

(12)

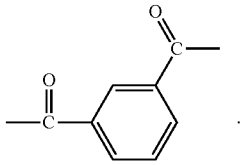

2. The electrophotographic photosensitive member according to claim 1, wherein the divalent group represented by the formula (2) is a divalent group represented by formula (6)

(6)

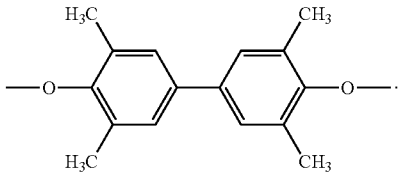

3. The electrophotographic photosensitive member according to claim 1, wherein the divalent group represented by the formula (2) is a divalent group represented by any of formulae (7) to (9)

(7)

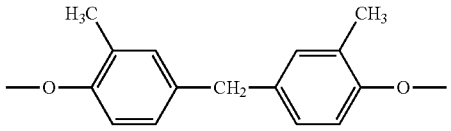

(8)

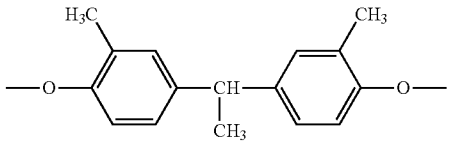

(9)

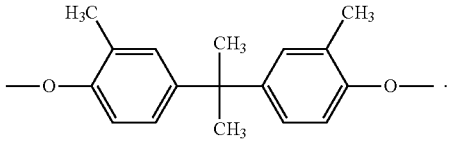

4. The electrophotographic photosensitive member according to claim 1, wherein the divalent group represented by the formula (4) is a divalent group represented by formula (10)

(10)

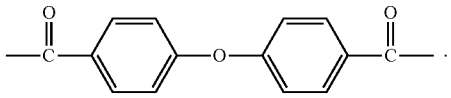

5. The electrophotographic photosensitive member according to claim 1, wherein the content of the organic compound is 0.4 to 1.4% by mass based on a gallium phthalocyanine in the gallium phthalocyanine crystal.

6. The electrophotographic photosensitive member according to claim 1, wherein the charge transporting layer is formed using a solvent having a dipole moment of 1.0 D or less.

7. The electrophotographic photosensitive member according to claim 6, wherein the solvent is selected from the group consisting of xylene and dimethoxymethane.

8. The electrophotographic photosensitive member according to claim 1, wherein the gallium phthalocyanine crystal is a hydroxygallium phthalocyanine crystal.

9. The electrophotographic photosensitive member according to claim 1, wherein the gallium phthalocyanine crystal is a chlorogallium phthalocyanine crystal.

10. The electrophotographic photosensitive member according to claim 1, wherein the weight average molecular weight of the polyester resin is 80000 to 300000.

11. A process cartridge detachably attachable to a main body of an electrophotographic apparatus integrally supports an electrophotographic photosensitive member and at least one unit selected from the group consisting of a charging unit, a developing unit and a cleaning unit, wherein the electrophotographic photosensitive member comprising:

a support; and a charge generating layer and a charge transporting layer on the support, wherein the charge generating layer comprises:

a gallium phthalocyanine crystal in which an organic compound is contained, wherein the organic compound is at least one compound selected from the group consisting of N-methylformamide, N-propylformamide, and N-vinylformamide, the content of the organic compound is 0.1% by mass or more and 1.5% by mass or less based on a gallium phthalocyanine in the gallium phthalocyanine crystal, and the charge transporting layer comprises a polyester resin having a structural unit represented by formula (1), $$-(A\text{-}B)- \quad (1)$$

wherein, in the formula (1),

"A" represents a divalent group represented by formula (2), and

"B" represents a divalent group represented by formulae (4), (11), or (12)

(2)

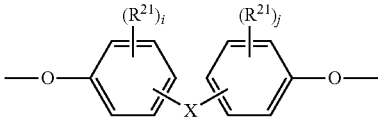

wherein, in the formula (2), $R^{21}$ and $R^{22}$ each independently represent an alkyl group, an aryl group or an alkoxy group, and i and j each independently represent an integer of 0 to 4; and in the formula (2), X represents a group represented by any of formulae (3-1) to (3-7):

(3-1)

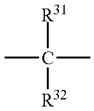

-continued (3-2)

(3-3)

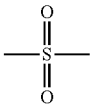

(3-4)

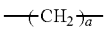

(3-5)

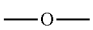

(3-6)

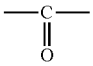

(3-7)

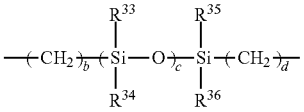

wherein, in the formula (3-1), $R^{31}$ and $R^{32}$ represent a hydrogen atom, a halogen atom, a substituted or unsubstituted alkyl group, a substituted or unsubstituted aryl group, a substituted or unsubstituted alkenyl group, or a group required to form a cycloalkyl ring or a heterocyclic ring by bonding of $R^{31}$ and $R^{32}$; in the formula (3-7), $R^{33}$ to $R^{36}$ each independently represent a hydrogen atom, a substituted or unsubstituted alkyl group, or a substituted or unsubstituted aryl group; and in the formula (3-4) and in the formula (3-7), "a" and "b" and "d" represent an integer of 0 to 20, and "c" represents an integer of 1 to 500;

(4)

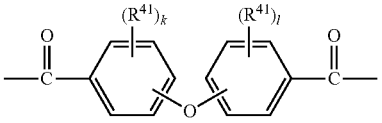

wherein, in the formula (4), $R^{41}$ and $R^{42}$ each independently represent an alkyl group, an aryl group or an alkoxy group, and "k" and "l" each independently represent an integer of 0 to 4; and (11)

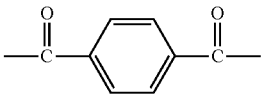

(12)

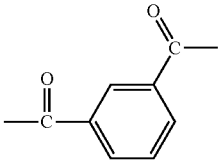

12. An electrophotographic apparatus comprising an electrophotographic photosensitive member, and a charging unit, an exposing unit, a developing unit and a transferring unit wherein the electrophotographic photosensitive member comprising:

a support; and a charge generating layer and a charge transporting layer on the support, wherein the charge generating layer comprises:

a gallium phthalocyanine crystal in which an organic compound is contained, wherein the organic compound is at least one compound selected from the group consisting of N-methylformamide, N-propylformamide, and N-vinylformamide, the content of the organic compound is 0.1% by mass or more and 1.5% by mass or less based on a gallium phthalocyanine in the gallium phthalocyanine crystal, and the charge transporting layer comprises a polyester resin having a structural unit represented by formula (1), $$-(A\text{-}B)- \quad (1)$$

wherein, in the formula (1),

"A" represents a divalent group represented by formula (2), and

"B" represents a divalent group represented by formulae (4), (11) or (12), (2)

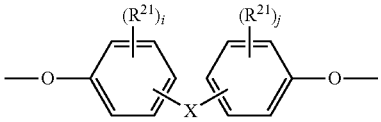

wherein, in the formula (2), $R^{21}$ and $R^{22}$ each independently represent an alkyl group, an aryl group or an alkoxy group, and i and j each independently represent an integer of 0 to 4; and in the formula (2), X represents a group represented by any of formulae (3-1) to (3-7):

(3-1)

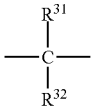

(3-2)

(3-3)

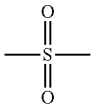

(3-4)

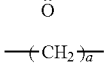

-continued (3-5)

(3-6)

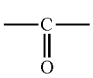

(3-7)

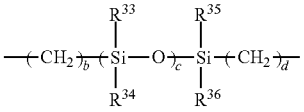

wherein, in the formula (3-1), $R^{31}$ and $R^{32}$ represent a hydrogen atom, a halogen atom, a substituted or unsubstituted alkyl group, a substituted or unsubstituted aryl group, a substituted or unsubstituted alkenyl group, or a group required to form a cycloalkyl ring or a heterocyclic ring by bonding of $R^{31}$ and $R^{32}$; in the formula (3-7), $R^{33}$ to $R^{36}$ each independently represent a hydrogen atom, a substituted or unsubstituted alkyl group, or a substituted or unsubstituted aryl group; and in the formula (3-4) and in the formula (3-7), "a" and "b" and "d" represent an integer of 0 to 20, and "c" represents an integer of 1 to 500;

(4)

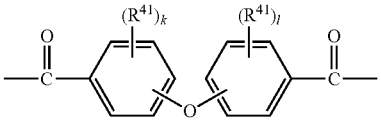

wherein, in the formula (4), $R^{41}$ and $R^{42}$ each independently represent an alkyl group, an aryl group or an alkoxy group, and "k" and "l" each independently represent an integer of 0 to 4; and (11)

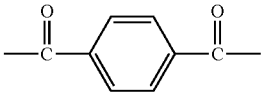

(12)

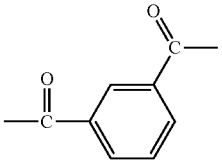

* * * * *